US008590194B2

(12) United States Patent
Fuertes Cameno et al.

(10) Patent No.: US 8,590,194 B2
(45) Date of Patent: Nov. 26, 2013

(54) NAME PLATE

(76) Inventors: Pablo José Fuertes Cameno, Madrid (ES); Alexandre Claude Jean François, Etang la Ville (FR)

( * ) Notice: Subject to any disclaimer, the term of this patent is extended or adjusted under 35 U.S.C. 154(b) by 32 days.

(21) Appl. No.: 12/444,589

(22) PCT Filed: Oct. 25, 2006

(86) PCT No.: PCT/ES2006/070158
§ 371 (c)(1),
(2), (4) Date: Sep. 25, 2009

(87) PCT Pub. No.: WO2008/049936
PCT Pub. Date: May 2, 2008

(65) Prior Publication Data
US 2010/0011642 A1 Jan. 21, 2010

(51) Int. Cl.
*G09F 3/18* (2006.01)

(52) U.S. Cl.
USPC ..... 40/661.09; 40/626; 283/81

(58) Field of Classification Search
USPC ..... 40/661.09, 626, 630, 625
See application file for complete search history.

(56) References Cited

U.S. PATENT DOCUMENTS

| | | | | |
|---|---|---|---|---|
| 4,592,976 | A * | 6/1986 | Whitehead | 430/10 |
| 5,103,583 | A * | 4/1992 | VanErmen | 40/638 |
| 5,240,789 | A | 8/1993 | Breen et al. | |
| 5,273,798 | A | 12/1993 | Miner | |
| 5,398,435 | A * | 3/1995 | Kanzelberger | 40/1.5 |
| 5,551,729 | A | 9/1996 | Morgan | |
| 5,770,283 | A * | 6/1998 | Gosselin et al. | 428/35.7 |
| 6,860,045 | B1 * | 3/2005 | Sadler et al. | 40/1.5 |
| 6,899,944 | B2 * | 5/2005 | Tanaka et al. | 428/195.1 |
| 2007/0204493 | A1 * | 9/2007 | Foley et al. | 40/299.01 |

FOREIGN PATENT DOCUMENTS

| | | |
|---|---|---|
| EP | 0 985 547 | 3/2000 |
| ES | 2 186 339 | 5/2003 |
| WO | 97/44202 | 11/1997 |
| WO | 00/46122 | 8/2000 |

* cited by examiner

*Primary Examiner* — Kristina Junge
(74) *Attorney, Agent, or Firm* — Ladas & Parry LLP

(57) ABSTRACT

An identification plate designed to be bonded to the wall of an object requiring protection, such as a computer, providing identification and/or recovery information for the said object if it is lost or stolen, comprises first information about the object which is located on a first plate and second information about the object which is located on a second plate, and is characterized in that the second plate is located in a window provided within the first plate, and that the level of protection for the second information is greater than that for the first information.

19 Claims, 2 Drawing Sheets

NAME PLATE

SCOPE OF THE INVENTION

This invention relates to an identification plate which is intended to be placed on the side of an object which it is desired to protect, providing information for the identification and/or recovery of the said object.

BACKGROUND TO THE INVENTION

Desktop and personal computers, among other objects of value, have conventionally been a target for theft and robbery because, among other things, of their ready portability and the possibility that they can be resold. For this reason many identification systems which in some way indelibly identify the object when incorporated with it, showing that it is a stolen object and therefore making its resale difficult, have been conceived in the art.

For example, U.S. Pat. No. 2,225,520 discloses a stamp or seal especially designed to demonstrate that a fee has been paid, the authenticity of which can be verified by scraping off the upper layers of the seal, which exposes a mark or print authenticating the seal.

French patent FR 2,369,639 describes an anti-theft identification label which provides identification and/or recovery information printed onto the inner surface of the label using an ink which has greater affinity for the adhesive covering the surface than for its own plastic backing on which it is printed, such that any attempt to remove the label will result in at least some of the adhesive together with the information printed upon it remaining stuck on the object being protected.

Finally, European patent EP 0,465,305 discloses an identification plate showing identification information for the object on its top surface, and which also includes recovery information printed on its bottom surface, which if the plate is removed is transferred through adhesion to the wall of the object being protected, thus indicating that it is a stolen article.

All these identification plates in the prior art start from the basis that the weak point in the system is the adhesive joining the plate to the wall of the object requiring identification. However, present-day high-strength adhesives to a large extent make it difficult to tear off the plate, so that the weak point in the system is not the joint between the plate and the wall of the object requiring protection, but the upper layers of the plate, which are capable of being removed by abrasion, it then being possible to gain access to the printed information which might be erased, for example by abrasion, thereby neutralising the plate identification system.

SUMMARY OF THE INVENTION

The problem which has to be solved through this invention is therefore that of providing an identification plate for objects such as computers, etc., whose identification and/or recovery information cannot be erased, at least not totally, by abrading off the upper layers of the plate.

The solution is based on the provision of an identification plate which has two separate information zones having two different levels of protection in which one of these zones, which has a lower level of protection, displays first information such as information identifying the object, for example its identification code, the registered trade mark or logo of the company responsible for identification and/or recovery of the object, text dissuading theft or a combination of the above, and in which the second information zone, which has a higher level of protection, shows second information such as the information which is most necessary in the case of loss or theft of the object-object recovery information, for example the address or contact telephone number for the persons who wish to return the object to its lawful owner.

In this context, by "level of protection of information" is meant the ability of the substrate on which the information is printed to preserve the legibility of the said information from any change, especially erasure of all or part of it.

Also, "identification information" means any appropriate information for identifying the object requiring protection.

Also, by "recovery information" is meant any appropriate information so that the object can be recovered or returned to its lawful owner once it has been lost or stolen.

As a consequence a first aspect of the invention relates to an identification plate which is attached to a wall of an object requiring protection, which bears first information (2) on the object and second information (7) on the object, characterised in that the first information (2) on the object is located on a first plate (1) and the second information (7) on the object is located on a second plate (6) which is located in a window provided within the first plate (1), and in that the level of protection of the second information (7) is greater than that for the first information (2).

An identification plate such as that described here has the additional advantage that the ink used to print the information in the first layer can be normal printing ink for the material of which the layer (normally PVC) is made and there is no need to use special printing techniques such as has been the case in the prior art, for example by means of vapour-phase deposition, in European patent EP 0,465,305.

BRIEF DESCRIPTION OF THE FIGURES

FIG. 2 shows in cross-section a preferred embodiment of the identification plate according to the invention. In this it will be seen that the information (2) identifying the object is printed on the top surface of the first plate (1), while the recovery information (7) for the object is printed on the bottom surface of a second plate (6), which is a transparent film located in a window provided within the first plate (1). Finally the assembly is protected by means of a protective layer (3), such as a bead of transparent resin, a high strength varnish or the like.

DETAILED DESCRIPTION OF THE INVENTION

Figure 1:
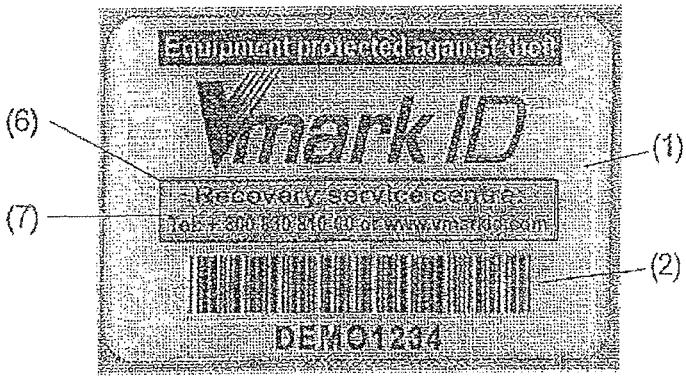
FIG. 1 shows a plan view of an identification plate according to the invention which bears identification information (2) for the object and recovery information (7) for the object in such a way that the information (2) identifying the object is located on a first plate (1) and the recovery information (7) for the object is located on a second plate (6) which is located in a window provided within the first plate (1).
Figure 2:
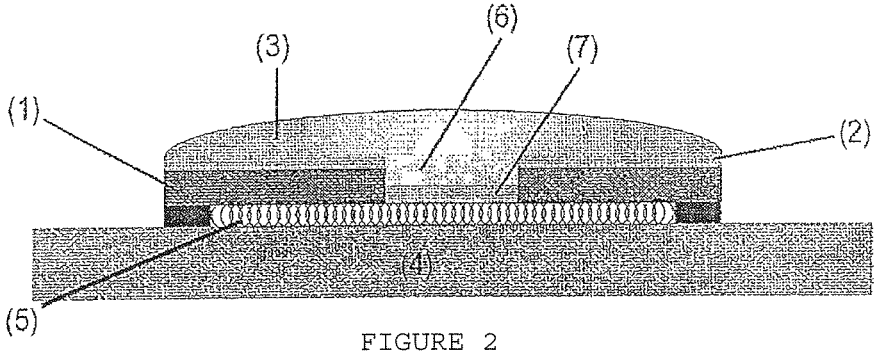
Figure 3:
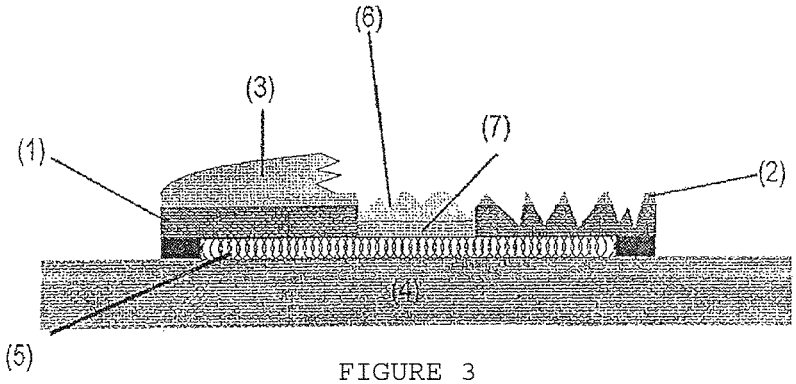
FIG. 3 shows an identification plate constructed according to the preferred embodiment of the invention, the top surface of which has been worn away with the intention of erasing the recovery information. Here it will be noted that although the protective layer (3) has been removed, the recovery information (7) for the object printed on the bottom surface of the second plate (6) is still protected by its transparent film (6) which remains wholly or partly present, and the text can be read through it even though the surface has been abraded.

The identification plate according to the invention comprises two parts: a first plate (1) which has first information (2) having a first level of protection, such as the registered trade mark or logo of the company responsible for protection of the equipment, text dissuading theft of the type "equipment protected against theft" or an individual bar code to aid identification of the equipment, or any combination of the above, printed on its surface. This is preferably made of PVC, although it may also be manufactured from other plastics or even metal, and its colour should be white, grey or some other background colour. The information (2) on the first plate (1) can be printed using any normal technique for printing on the material of which the plate is made. This first plate (1) is provided with a window opening onto its interior, which may be of any shape although it is preferably rectangular, round or elliptical, designed so that a second plate (6) on which second information (7) having a second level of protection is inserted in it so that the level of protection of the second information (7) is greater than that for the first information (2). Any method which provides a greater level of protection for the second information than the first information is considered to be included within the scope of this invention. However, in a preferred embodiment of the invention, illustrated in FIGS. 2 and 3, this is achieved through the provision of a first plate (1) which has the identification information (2) for the object printed on its surface and which is provided with a window opening onto its interior designed for the insertion therein of a second plate (6) bearing recovery information (7) for the object printed on its bottom surface. The second plate may be located in any position within the first plate, preferably centred with respect thereto, although it may also be at the top, bottom, right hand side or left hand side, and be horizontal or vertical. Given that the second plate (6) is a transparent film, either colourless or coloured, preferably of transparent PVC or glass, the information printed on its bottom side can be read through that film. When the identification plate according to the invention is finely bonded to the wall of the object requiring protection, the transparent film will adhere directly to the wall of the object by means of its lower surface, that is to say by the surface which bears the printed information for recovery of the object, so that the information printed on it is permanently bonded to the wall of the object, forming an indelible block therewith.

In the preferred embodiment of the invention the identification plate according to the invention also comprises at least one protective layer (3) which covers both the first plate (1) and the second plate (6), such as a bead of transparent resin, high protection varnish or the like.

Figure 4:
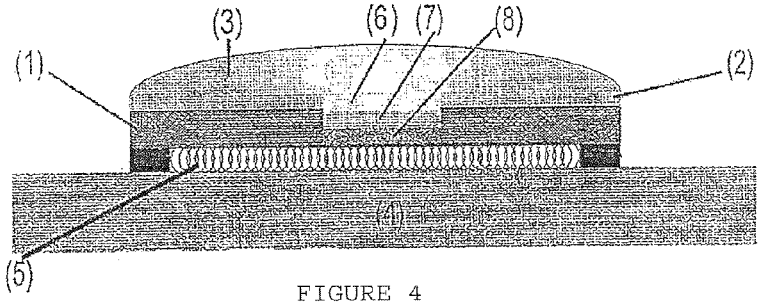
FIG. 4 shows a view in cross-section of an alternative embodiment of the identification plate according to the invention. In this it will be seen that the information (2) identifying the object is printed on the top surface of the first plate (1), while the recovery information (7) for the object is printed on an intermediate surface of the second plate which in this case comprises a set of stratified material comprising at least two layers (6, 8) of material, the lower surface (8) of a preferably coloured non-transparent material and the upper layer (6) of a transparent preferably coloured material.
Figure 5:
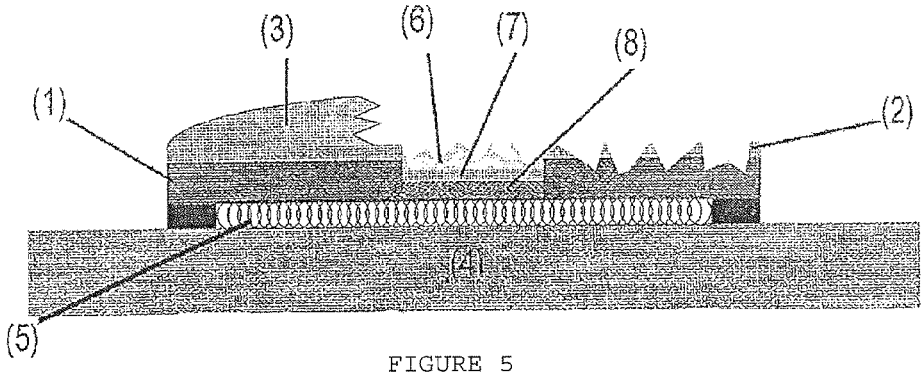
FIG. 5 shows an identification plate constructed according to the alternative embodiment of the invention, the top surface of which has been abraded with the intention of erasing the recovery information. In this it will be seen that although the protective layer (3) has been removed, the recovery information (7) for the object printed on the intermediate surface of the second plate assembly is still protected by the upper layer (6) of the stratified assembly, which remains wholly or partly intact, and the text can be read through it, even when the surface has been abraded.

In an alternative embodiment of the invention, shown in FIGS. 4 and 5, the second plate comprises a set of stratified material comprising at least two layers (6, 8) of material and second information (7) is printed on at least one of the intermediate surfaces of the layers of the stratified material so that the said second information is enclosed between the two surfaces of the stratified material. In this way, for example, the said second information (7) can be printed on the upper surface of a layer (8) of non-transparent material, for example yellow or otherwise coloured PVC, and upon this can be placed a layer (6) of transparent material, for example transparent PVC. Preferably all the layers in the stratified material are joined together permanently for example by means of hot pressing (with pressure and heat) or using a transparent adhesive. In this way the assembly making up the second plate (6, 7, 8) ultimately becomes a single piece which cannot be separated into its original components, and in which the information which is printed on it has a very high level of protection.

Anyone who wishes to remove the identification plate according to the invention will in the first place attempt to remove the plate completely, finding that this is not easy because of the high strength of the adhesive (5) used, which may be of any type although preferably a cyanoacrylate. He will then attempt to erase the identification information (2) or recovery information (7), in order to do which he will first attempt to remove the bead (3) of protective resin, which can be achieved with some force, and secondly to erase or abrade the identification information (2) printed on the first plate (1) which has a lower level of protection, in order to continue with the recovery information (7) printed on the assembly of the second plate (6, 7 or 6, 7, 8), which has a greater level of protection. Nevertheless, on reaching this second plate he will find that it is not possible to erase information from this plate using normal means because the recovery information (7) is printed on the bottom surface or an intermediate surface in the assembly forming that plate, as a result of which it remains protected by the plate itself, the information being legible even after an attempt at abrasion.

The first plate (1) can be manufactured from any material which is suitable for bonding to a surface on one side and may bear printed information on the other. Preferably it will be made of PVC, more preferably of coloured PVC. The window which will be provided in this first plate may be of any shape, although preferably it will be rectangular, round or elliptical, and may be located in any position with respect thereto.

The second plate (6) may be manufactured in the preferred embodiment of the invention using any material which can bear printed information on one surface and which can be bonded to a surface on that same side. Preferably it will be resistant to chemicals and will be made of colourless or coloured, for example red or yellow, PVC. In the alternative embodiment of the invention the second plate may be manufactured of any stratified material which is capable of bearing information printed on one of its internal surfaces and of being bonded to a surface by means of one of its external surfaces. Preferably it will be resistant to chemicals and will be made of colourless or coloured, for example red or yellow, PVC.

The protective layer (3) protecting the assembly of the first and second plates may be manufactured from any transparent material which can be deposited onto the aforesaid components, providing protection for them. Preferably it will be a bead of transparent resin or a high protection varnish.

Thus the identification plate according to the invention provides the desired advantages of an unalterable view of the identification and/or recovery information printed on the bottom surface of the transparent film even though an attempt is made to erase the upper layers of the plate through abrasion.

The invention claimed is:

1. A portable object requiring protection, having bonded to a wall thereof an identification plate comprising first information about the object and second information about the object, wherein the first information about the object is located on a first plate and the second information about the object is printed on a second plate which is permanently fixed in a window provided within the first plate and is in contact with the wall of said portable object, said second plate comprising means for protecting the second information from erasure that, when partially abraded, can form a jagged layer of material that covers and protects the second information, said second plate having an object-facing surface, said second information being located on the object-facing surface of said second plate such that the second information about the object has greater resistance to erasure than the first information about the object, said identification plate further comprising a bottom layer which includes a high strength adhesive on its lower surface bonding said first and second plates to said portable object, wherein the high strength adhesive is disposed between the surface comprising the second information and the wall of the portable object.

2. The portable object according to claim 1 wherein the identification plate further comprises at least one protective layer (3) substantially covering both the first plate (1) and the second plate (6, 8).

3. The portable object according to claim 2, wherein the at least one protective layer substantially covering both the first plate and the second plate is a bead of transparent resin or a high protection varnish.

4. The portable object according to claim 1, wherein the second plate of said identification plate comprises a transparent film printed on its underside.

5. The portable object according to claim 4 wherein the transparent film is of transparent PVC or glass.

6. The portable object as claimed in claim 5 wherein the transparent film of PVC or glass is colored.

7. The portable object as claimed in claim 5 wherein the transparent film of PVC or glass is colorless.

8. The portable object according to claim 1, wherein the first plate of the identification plate is of plastics material or metal.

9. The portable object according to claim 1, wherein the window provided in the first plate of the identification plate is of rectangular, round or elliptical shape.

10. The portable object according to claim 1, wherein the high strength adhesive is a cyanoacrylate.

11. The portable object according to claim 1, which is a a computer.

12. A portable object requiring protection, having bonded to a wall thereof an identification plate, the portable object being larger than the identification plate with ends of the identification plate being spaced from ends of the portable object, the identification plate comprising first information about the object and second information about the object, wherein the first information about the object is located on a surface of a first plate the second information about the object is located on a second plate which is located in a window provided within the first plate, wherein the second plate of said identification plate comprises a stratified material incorporating at least two layers permanently bonded together to form a single piece which cannot be separated into its original components, and the second information is printed on at least one intermediate surface of the stratified material in such a way that the said second information is enclosed between two of the layers of the stratified material, wherein a bottommost layer of the at least two layers comprises a high strength adhesive on its lower surface which is bonded directly to the wall of the portable object, and wherein the at least one intermediate surface of the stratified material on which the second information is printed is disposed closer to the bottommost layer than is the surface of the first plate on which the first information is located such that the second information about the object has greater resistance to erasure than the first information about the object.

13. The portable object according to claim 12, wherein the identification plate comprises a layer of coloured PVC on which second information is printed and a layer of transparent PVC placed above it.

14. The portable object according to claim 12, wherein the identification plate comprises a layer of coloured PVC on which second information is printed and a layer of transparent PVC placed above it.

15. The portable object according to claim 12, wherein the layers incorporated in the stratified material permanently bonded together have been bonded by hot pressing or by means of a transparent adhesive.

16. The portable object according to claim 12, wherein the second plate is made of a material that is resistant to chemicals.

17. The portable object according to claim 12, wherein the stratified material comprises a topmost layer comprising means for protecting the second information from erasure that, when partially abraded, can form a jagged layer of material that covers and protects the second information.

18. The portable object according to claim 17, wherein the layers incorporated in the stratified material are permanently bonded together by hot pressing.

19. The portable object according to claim 17, wherein the object is a computer and the high strength adhesive bonds the bottom layer directly to the wall of the computer.

* * * * *